United States Patent [19]

Shaw et al.

[11] 4,358,422

[45] Nov. 9, 1982

[54] LOW TIN JEWEL METAL ALLOY

[75] Inventors: Ian M. Shaw, Wayne; William R. Stack, Mahwah, both of N.J.

[73] Assignee: ASARCO Incorporated, New York, N.Y.

[21] Appl. No.: 259,409

[22] Filed: May 1, 1981

[51] Int. Cl.[3] ..... C22C 12/00; C22C 30/04

[52] U.S. Cl. ..... 420/577; 420/580; 420/589

[58] Field of Search ..... 75/134 B, 134 D, 166 C

[56] References Cited

U.S. PATENT DOCUMENTS

| | | | |
|---|---|---|---|
| 1,452,750 | 4/1923 | Mulligan | 75/134 D |
| 1,860,095 | 5/1932 | Harris | 75/166 C |
| 2,117,282 | 5/1938 | Austin | 75/134 D |
| 2,351,477 | 6/1944 | Bouton et al. | 75/166 C |
| 2,411,560 | 11/1946 | Speed | 75/134 D |
| 2,508,488 | 5/1950 | Bouton et al. | 75/134 D |
| 3,449,818 | 6/1969 | Lowe et al. | 75/134 D |

*Primary Examiner*—L. Dewayne Rutledge
*Assistant Examiner*—David A. Hey
*Attorney, Agent, or Firm*—Daniel R. Zirker; Kenneth A. Koch

[57] ABSTRACT

A bismuth-lead alloy containing lesser amounts of tin, antimony and zinc has been developed for use as a fusible metal, and particularly as a jewel metal alloy. The alloy meets the standards set by presently available jewel metals, has a lower melting temperature, better casting properties, and is less expensive than currently used alloys.

10 Claims, 1 Drawing Figure

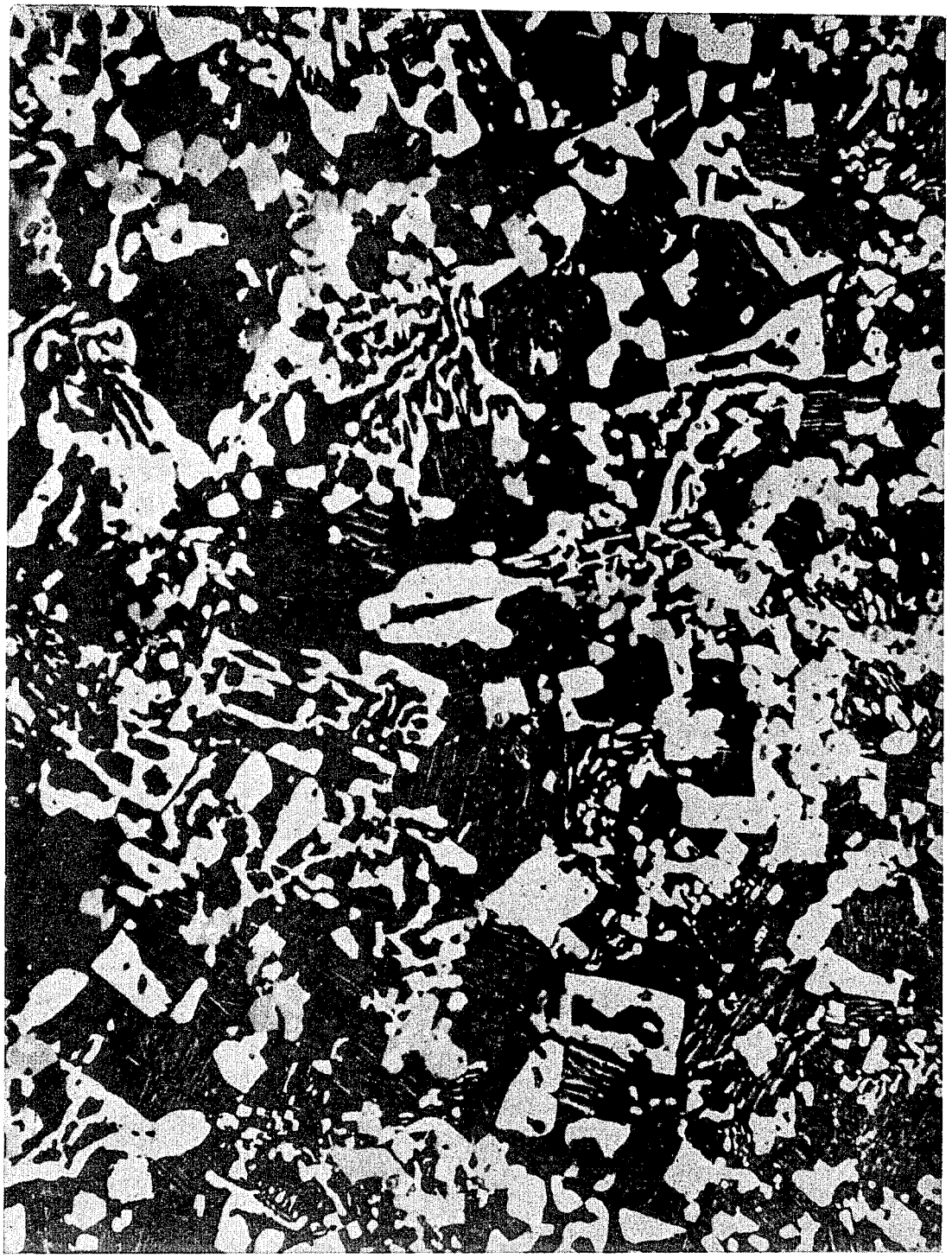

LOW TIN JEWEL METAL ALLOY

BACKGROUND OF THE INVENTION

This invention is related to an alloy useful in fusible metal and metal ornament applications, and more particularly, to a jewel metal alloy having bismuth and lead as the major constituents of its composition.

Currently, most alloys fabricated into costume jewelry and the like are principally composed of tin and lead, or are of "pewter" composition, which is an alloy of at least 92% tin, with the balance being antimony and copper. Another particularly popular alloy that has found widespread commercial use has a composition that ranges between 23–36% tin, with the balance being mostly lead. However, the price of tin is high, and thus there is a need for a low-tin or tin-free alloy, which has either equal or superior properties to the high tin alloys already in use.

Most jewel metal ornaments are manufactured by a process in which the metal is cast into rubber molds which are shaped to whatever design is desired. The molds are usually hand made by the manufacturer, while the alloy employed is required to fulfil only general standards, as precise specifications for a metal are practically nonexistent in the industry. The alloy must have excellent fluidity in order that it can be easily cast into a variety of different shapes. The casting temperature of the metal should be as low as practical, so as to prolong the life of the rubber mold, while the porosity of the alloy should be minimal, for a porous alloy will cause the plating chemicals to "bleed out", i.e. the plating electrolyte flowing out of the cast alloy, and consequently damage the finished metal surface. The jewel metal must also be sufficiently strong and durable to withstand the mechanical strains inherent in the manufacturing process, particularly the tumbling and polishing steps. Also, of course, the cost of the alloy should be as low as possible.

OBJECTS OF THE INVENTION

Accordingly, it is an object of the invention to produce a fusible metal alloy which has superior casting properties, a lower casting temperature, is less damaging to the casting molds, and has satisfactory mechanical characteristics.

It is another object of the invention to produce a jewel metal alloy which is more economical than currently available lead-tin alloys, without any loss of physical performance.

It is still another object of the invention to produce a bismuth-lead alloy which has significantly less tin than conventional jewel alloys.

SUMMARY OF THE INVENTION

The invention consists of a fusible, low melting metal alloy that is characterized by having excellent casting properties, particularly spin casting properties, excellent fluidity with minimal porosity, a liquidus temperature of below 125° C. and preferably of about 115° C., and a solidus temperature of below 125° C. and preferably about 108° C., having satisfactory mechanical properties, consisting essentially of a bismuth-lead eutectic, having a bismuth to lead ratio of about 1.3 to 1 containing about 45.0–55.0 wt. % bismuth and about 34.5–42.5 wt. % lead, about 1.0–15.0 wt. % tin, about 1.5 to 5.0 wt. % antimony; and about 0.05 to 1.00 wt. % zinc.

BRIEF DESCRIPTION OF THE DRAWINGS

FIG. 1 is a photomicrograph of the preferred alloy illustrating the several composition phases present.

DESCRIPTION OF THE INVENTION

In order to meet the product specifications required of a jewel metal, the alloy must measure up to a rigorous set of criteria, one of which is that it have excellent casting properties. One such property is good fluidity, that is, the ability to easily flow, or be cast into finely detailed shapes. Another desired casting property of the alloy is that the casting temperature, which is the lowest temperature at which the molten metal will easily and fully fill a mold, be as low as possible so as to lengthen rubber mold life. Similarly the solidus point, the temperature at which all the liquid metal has crystallized into the solid state, is an important parameter to consider for the usage of the cast part, i.e. that the part does not begin to remelt in common usage.

Since the eutectic composition is the corresponding lowest temperature at which a eutectic bearing alloy system can melt, or, fuse together, and frequently has the best casting properties, most jewel metal research centers around the eutectic compositions of eutectic type alloy systems.

It was decided to examine bismuth eutectic systems, in particularly bismuth-tin and bismuth-lead. While the former proved to be undesirable, the bismuth-lead system showed surprising potential. The binary bismuth-lead alloy has a eutectic ratio of about 1.3 to 1.0, with an optimum composition of 56.5 wt. % bismuth and 43.5 wt. % lead. All the alloys studied near this composition exhibited a liquidus temperature, i.e. the temperature at which solidification starts on cooling, of 125° C. or lower, with a narrow freezing range. In contrast, the commonly used "32" tin-lead alloy has a liquidus temperature of about 255° C. and a solidus temperature of about 180° C., producing a wide freezing range.

The binary bismuth-lead eutectic alloy has satisfactory mechanical properties, but is hampered by poor fluidity as well as large shrinkage voids and significant gas porosity as cast. In an effort to diminish these flaws, tin was added to the binary eutectic. The suggested range of tin concentrations is about 1 to 15 wt. % in an alloy where the other four components are at their optimum concentrations, for above 15 wt. % the alloy becomes brittle, and consequently has insufficient fracture strength, while below 1% poor fluidity, increased gas porosity, as well as the large shrinkage voids which characterized the binary alloy are in evidence. The preferred range of tin is about 4.7 to 5.2 wt. %, with 5 wt. % being the most preferred composition. Below 5.0 wt. % the binary alloy characteristics are more in evidence, while above 5.0 wt. % the cost of tin begins to reduce the economic advantage of the alloy over jewel metals currently available.

The addition of 5% tin, while improving fluidity and reducing gas porosity, does not diminish shrinkage problems. Therefore, antimony was added in an effort to inhibit the shrinkage, which occurs equally in both static and spin-cast pieces. It was found that antimony, when present from about 1.5 to 5.0 wt. %, drastically reduced the alloy's shrinkage without damaging tensile strength. Above 5.0 wt. % the alloy begins to become brittle with an accompanying reduction in fluidity. The preferred antimony concentration is about 1.8 to 3.0 wt.

% with 2.0 wt. % being the most preferred composition.

Although tin is helpful in reducing the gas porosity, i.e. the gas that is dissolved in the metal during processing, it does not remove all the gas. Consequently, a "degassing" element was added to the system in an effort to totally eliminate the gas porosity. Zinc, when present in about 0.05 to 1.00 wt. % in the alloy, and preferably, from about 0.50 to 0.65 wt. %, acts as a degasser to remove gas porosity without impairing the other desirable alloy properties. Other degassers, such as magnesium, aluminum, boron and the like, have some success in this role, but zinc, and most preferably, about 0.50 wt. % zinc, is the preferred composition. Without zinc, the surface finish of the alloy frequently will "bleed", thus greatly reducing the finished ornaments appearance. The range of zinc concentrations is limited on the high side by the solubility limit of zinc in the alloy; also the flow characteristics of the alloy surprisingly appear to be improved by the addition of the element.

Viewing FIG. 1, a 400 X micrograph of the preferred embodiment of the invention, an alloy having the preferred composition (wt. %) and properties is displayed:

| | |
|---|---|
| Bi | 51.3 |
| Pb | 41.2 |
| Sn | 5.0 |
| Sb | 2.0 |
| Zn | 0.5 |
| Properties of the Alloy | |
| Liquidus T | 115° C. |
| Solidus T | 108° C. |
| Density | 9.0 gram/cc |
| Elongation | 7% |
| Ultimate Tensile Strength | 6700 psi. |

Several different phases are clearly present, with the dark structure being the bismuth-lead eutectic. The dark grey phase, which is superimposed over several of the large white areas, is a tin-antimony-zinc compound, while a second light grey phase is present within the darker grey phase. Although applicants do not wish to be bound by theory, it is hypothesized that the tin-antimony-zinc compound functions as a nucleating agent for grain refining the basic bismuth-lead structure, thus eliminating the need for any additional grain refiners. This is an important and unexpected property, for such conventional grain refiners as elemental sulfur often float out of the lead-tin alloys in the molten state, thus leading to a gradual erosion in properties over a period of time. However, in the applicants' novel fusible metal alloy, the grain refinement is believed to be inherent, and accounts for the reduced shrinkage, porosity and improved fluidity. The large white areas are primary bismuth.

Obviously, numerous modifications and variations of the invention are possible in light of the above teachings. It is therefore to be understood that within the scope of the appended claims the invention may be practiced otherwise than as specifically described herein.

We claim:

1. A jewel metal alloy having excellent casting characteristics, low liquidus and solidus temperatures and minimal gas porosity comprising:

a bismuth-lead based alloy with a bismuth-lead ratio of about 1.3 to 1.0 having about 45.0–55.0 wt. % bismuth and about 34.5–42.5 wt. % lead;

about 1.0 to 15.0 wt. % tin;

about 1.5 to 5.0 wt. % antimony;

about 0.05 to 1.00 wt. % zinc.

2. An alloy as claimed in claim 1 wherein the bismuth-lead compositions are about 51.3 wt. % bismuth and about 41.2 wt. % lead.

3. An alloy as claimed in claim 1 wherein the amount of tin is about 4.7 to 5.2 wt. %.

4. An alloy as claimed in claim 1 wherein the amount of antimony is about 1.8 to 3.0 wt. %.

5. An alloy as claimed in claim 1 wherein the amount of zinc is about 0.50 to 0.65 wt. %.

6. A jewel metal alloy having excellent casting characteristics, low liquidus and solidus temperatures and minimal gas porosity comprising:

a bismuth-lead composition with a bismuth-lead ratio of about 1.3 to 1.0 having about 45.0–55.0 wt. % bismuth and about 34.5–42.5 wt. % lead;

about 4.7 to 5.2 wt. % tin;

about 1.8 to 3.0 wt. % antimony;

about 0.50 to 0.65 wt. % zinc.

7. An alloy claimed in claim 6 wherein the bismuth-lead composition has about 51.3 wt. % bismuth and about 41.2 wt. % lead.

8. An alloy as claimed in claim 6 wherein the amount of tin is about 5.0 wt. %.

9. An alloy as claimed in claim 6 wherein the amount of antimony is about 2.0 wt. %.

10. An alloy as claimed in claim 6 wherein the amount of zinc is about 0.50 wt. %.

* * * * *